US008999158B2

(12) United States Patent
Irvin

(10) Patent No.: US 8,999,158 B2
(45) Date of Patent: Apr. 7, 2015

(54) IN-LINE FUEL CONDITIONER

(76) Inventor: Wallace Taylor Irvin, Alvaton, KY (US)

( * ) Notice: Subject to any disclaimer, the term of this patent is extended or adjusted under 35 U.S.C. 154(b) by 724 days.

(21) Appl. No.: 13/233,233

(22) Filed: Sep. 15, 2011

(65) Prior Publication Data

US 2012/0067802 A1 Mar. 22, 2012

Related U.S. Application Data

(60) Provisional application No. 61/383,652, filed on Sep. 16, 2010.

(51) Int. Cl.

| | |
|---|---|
| ***B03C 1/02*** | (2006.01) |
| ***B03C 1/28*** | (2006.01) |
| ***B03C 1/033*** | (2006.01) |

(52) U.S. Cl.

CPC ..... *B03C 1/286* (2013.01); *B03C 1/0332* (2013.01); *B03C 2201/18* (2013.01); *B03C 2201/20* (2013.01); *B03C 2201/30* (2013.01)

(58) Field of Classification Search

USPC ..... 210/222, 695; 123/538

See application file for complete search history.

(56) References Cited

U.S. PATENT DOCUMENTS

| | | | | |
|---|---|---|---|---|
| 5,360,164 | A | 11/1994 | Pape et al. | |
| 5,882,514 | A * | 3/1999 | Fletcher | 210/222 |
| 6,143,171 | A * | 11/2000 | Van Aarsen | 210/222 |
| 6,450,155 | B1 | 9/2002 | Arkfeld | |
| 2003/0010326 | A1 | 1/2003 | Arkfeld | |
| 2009/0277157 | A1 | 11/2009 | Martin et al. | |

FOREIGN PATENT DOCUMENTS

| | | | |
|---|---|---|---|
| CA | 2235885 | A1 | 5/1996 |
| CN | 2074820 | U | 4/1991 |
| CN | 2111373 | U | 7/1992 |
| CN | 2145876 | Y | 11/1993 |
| CN | 1134509 | A | 10/1996 |
| CN | 1299925 | A | 6/2001 |
| CN | 2729346 | Y | 9/2005 |
| EP | 0791746 | A1 | 8/1997 |
| JP | 2005171960 | A | 6/2005 |
| RU | 2144622 | C1 | 1/2000 |
| WO | 2009137710 | A2 | 11/2009 |

* cited by examiner

*Primary Examiner* — David A Reifsnyder

(74) *Attorney, Agent, or Firm* — Quarles & Brady LLP

(57) ABSTRACT

A fuel conditioner is provided for improving fuel combustibility and reducing emissions into the environment. The fuel conditioner may be placed in-line in a fuel delivery system for internal combustion engines and may include the following components: a first housing defining a sealed chamber, a fuel inlet in fluid communication with the sealed chamber, a second housing disposed within the sealed chamber, a magnet disposed in the second housing, a fuel outlet in fluid communication with the sealed chamber, and a flow path in the sealed chamber for flow of the liquid fuel between the fuel inlet and the fuel outlet. Along its flow path, the liquid fuel is split apart and passes through magnetic fields due to one or more magnets inside the second housing to condition the fuel to improve fuel combustibility and reduce toxic emissions.

17 Claims, 4 Drawing Sheets

IN-LINE FUEL CONDITIONER

CROSS REFERENCE TO RELATED APPLICATIONS

This application claims the benefit of U.S. Provisional Patent Application No. 61/383,652 filed Sep. 16, 2010 which is incorporated in its entirety herein for all purposes.

STATEMENT OF FEDERALLY SPONSORED RESEARCH OR DEVELOPMENT

Not applicable.

BACKGROUND OF THE INVENTION

The invention relates to a fuel conditioner configured to be used in-line in a fuel delivery system for an internal combustion engine and is designed to improve fuel combustibility and reduce harmful emissions.

Internal combustion engines are used in wide variety of applications including, but not limited to, automobiles, trucks, motorcycles, boats, aircraft, generators, and mobile equipment. During the application of such internal combustion engines, several substances are emitted as exhaust, such as carbon dioxide and water. However, these engines may also emit harmful toxins to the atmosphere due to incomplete combustion of fuel. Specifically, incomplete combustion of fuel may lead to emissions of carbon monoxide, hydrocarbons, and nitrogen oxides. These gases may be poisonous and lead to the degradation of the environment by producing smog and acid rain. While only small traces of these gases may be emitted from any specific engine due to incomplete combustion of fuel, the overall amount of these harmful emissions and their effects on the environment are quite large and drastic when considering the world-wide use of internal combustion engines burning gasoline or diesel fuels.

Easily seen, an improvement for an internal combustion engine system that leads to more complete combustion of gasoline and/or diesel fuel has the beneficial effect of not only increasing fuel efficiency for an engine, but also beneficial effects for the environment. By providing more complete combustion and increased fuel efficiency, less gasoline or diesel fuel would be consumed. Furthermore, more complete combustion results in less toxins emitted into the atmosphere.

Thus, there is a need for an in-line fuel conditioner that will improve fuel combustibility and reduce harmful emissions.

SUMMARY OF THE INVENTION

The present invention provides for a fuel conditioner placed in-line a fuel delivery system for internal combustion engines using gasoline or diesel fuel that is designed to improve fuel combustibility and reduce emissions. The in-line fuel conditioner also provides the additional benefit of collecting ferrous particles before the particles enter and cause harm to the engine.

In one aspect, the present invention provides an in-line fuel conditioner for receiving a flow of liquid fuel, the fuel conditioner includes a first housing that defines a sealed chamber and a second housing disposed within the sealed chamber. A magnet is disposed within the second housing. The fuel conditioner also includes a fuel inlet and a fuel outlet that are in fluid communication with the sealed chamber, such that a flow path in the sealed chamber exists for flow of the liquid fuel between the fuel inlet and the fuel outlet.

In another aspect, the present invention provides an in-line fuel conditioner wherein the second housing forms a seal around the magnet such that the liquid fuel does not contact the magnet. Such a seal provides the benefit of protecting the magnet from corrosion.

In a further aspect, the present invention provides an in-line fuel conditioner that includes a configuration wherein the second housing is placed within the sealed chamber such that liquid fuel may follow a flow path around all sides of the magnet that is disposed within the second housing. This may allow for the benefit of a greater density of the fuel to be exposed to the magnetic field by staying in closer proximity to the magnet.

In another aspect the invention provides for an in-line fuel conditioner that has the magnet arranged such that its magnetic south pole faces the fuel inlet and its magnetic north pole faces the fuel outlet.

A further aspect of the invention provides for an in-line fuel conditioner with a plurality of magnets, but where the total number of magnets is an odd number, and the magnets are arranged within the second housing in a distinct pattern. The magnet placed nearest the fuel inlet is arranged such that its magnetic south pole faces the fuel inlet and its magnetic north pole faces the fuel outlet. The magnet placed nearest the fuel outlet is arranged such that its magnetic north pole faces the fuel outlet and its magnetic south pole faces the fuel inlet. Any magnet placed in between the magnet placed nearest the fuel inlet and the magnet placed nearest the fuel outlet is arranged in the second housing such that its magnetic poles oppose the nearest pole of the magnet placed immediately upstream and the nearest pole of the magnet immediately downstream.

In yet a further aspect, the invention provides for an in-line fuel conditioner that includes an exit fuel line in fluid communication with a fuel outlet and an electromagnetic shield encasing the fuel exit line. The electromagnetic shield may protect the conditioned fuel from external magnetic and electromagnetic fields before the fuel enters the engine.

In another aspect, the invention provides for an in-line fuel conditioner that has a first housing defining a sealed chamber, a fuel inlet and a fuel outlet in fluid communication with the sealed chamber, a magnet disposed in the sealed chamber, an upstream plate with a hole, a downstream plate with a hole, and a flow path in the sealed chamber for flow of the liquid fuel moving between the fuel inlet and the fuel outlet. At least a portion of an outer surface of the upstream plate and at least a portion of an outer surface of the downstream plate engage the first housing. The flow path allows liquid fuel to flow from the fuel inlet through the hole in the upstream plate, the sealed chamber, the hole in the downstream plate, and the fuel outlet.

Furthermore, the invention provides for a flow tube to be disposed in the sealed chamber of the in-line fuel conditioner in another aspect of the invention. The flow tube connects a hole in the upstream plate to a hole in the downstream plate. The flow tube may be arranged in a helical pattern in the sealed chamber. The helical pattern provides the advantage of increasing the amount of time the fuel spends passing through the sealed chamber, and thus increasing the beneficial effects of the magnetic field on the fuel.

In another aspect, the present invention provides for a plurality of flow tubes disposed in the sealed chamber. Each flow tube connects a hole in the upstream plate to a hole in the downstream plate, such that all the liquid fuel that passes through the sealed chamber is restricted to flowing through the plurality of flow tubes. In this aspect, the multiple flow tubes may be arranged in a helical pattern in the sealed chamber.

In yet a further aspect, the present invention provides for an in-line fuel conditioner that has an outer surface of the upstream plate and an outer surface of the downstream plate in sealing engagement with the first housing such that the flow path of the liquid fuel is constrained to flowing from the fuel inlet through the hole in the upstream plate, the chamber, the hole in the downstream plate, and the fuel outlet. An axis of the hole in the upstream plate may be configured such that the axis of the hole is at an angle with respect to the longitudinal axis of the in-line fuel conditioner. The angled hole in the upstream plate may cause beneficial turbulence in the fuel flow path.

Moreover, in another aspect the present invention provides for an in-line fuel conditioner for receiving a flow of liquid fuel that has a first housing defining a sealed chamber, a fuel inlet and a fuel outlet that are in fluid communication with the sealed chamber, a second housing disposed within the sealed chamber, a magnet disposed in the second housing, an upstream plate and a downstream plate each having a hole, an upstream plug and a downstream plug, and a flow path in the sealed chamber for flow of the liquid fuel between the fuel inlet and the fuel outlet. The upstream plate engages the upstream plug and the downstream plate engages the downstream plug. The upstream plug and the downstream plug each sealingly engage the second housing. Moreover, an outer surface of the upstream plate and an outer surface of the downstream plate sealingly engage the first housing such that the flow path restricts the liquid fuel to flow from the fuel inlet through the hole in the upstream plate, the chamber, the hole in the downstream plate, and the fuel outlet.

These and still other advantages of the invention will be apparent from the detailed description and drawings. What follows is merely a description of preferred embodiments of the present invention. To assess the full scope of the invention the claims should be looked to, as the preferred embodiments are not intended to be the only embodiments within the scope of the claims.

DETAILED DESCRIPTION OF THE PREFERRED EMBODIMENT

Figure 1:
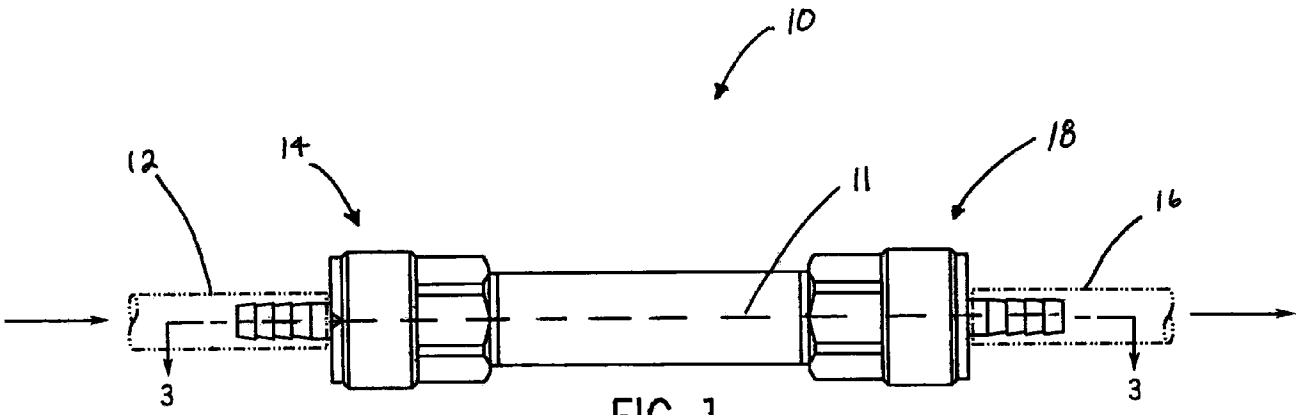
FIG. 1 is a side elevation view of an embodiment of an in-line fuel conditioner embodying the invention.

FIG. 1 displays the in-line fuel conditioner 10 in its assembled state placed in-line a fuel delivery system. The arrows in FIG. 1 show the direction fuel generally flows through the fuel delivery system for the internal combustion engine (not shown) through a longitudinal axis 11 of the in-line fuel conditioner 10. The in-line fuel conditioner 10 may be placed downstream of a fuel pump (not shown) and fuel filter (not shown)—if the apparatus with the internal combustion engine has such features—but is placed upstream of the fuel injection apparatus (not shown) that delivers fuel to the internal combustion engine. As seen in FIG. 1, the fuel line can be described as an entrance fuel line 12, which is in fluid communication with the fuel inlet 14 of the in-line fuel conditioner 10, and an exit fuel line 16, which is in fluid communication with the fuel outlet 18 of the in-line fuel conditioner 10.

Figure 2:
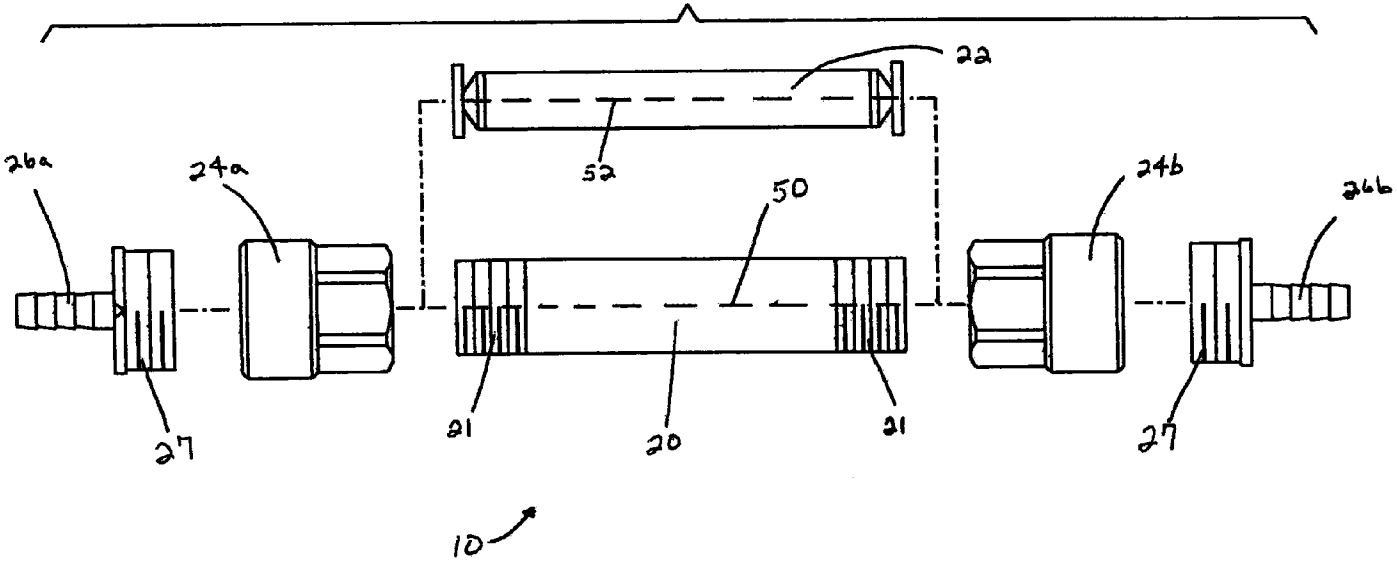
FIG. 2 is an exploded view of the in-line fuel conditioner displayed in FIG. 1.

Referring now to FIG. 2, the in-line fuel conditioner 10 is shown partially disassembled and may include the following components: a first housing 20; a second housing 22; connector nuts 24*a*, 24*b*; and fuel line connectors 26*a*, 26*b*. To assemble the in-line fuel conditioner 10, the second housing 22 is inserted within the first housing 20 and the connector nuts 24*a*, 24*b* are threaded over the first housing 20. In such an arrangement, the external thread pattern 21 on the first housing 20 must match the internal thread pattern 23 (seen in FIG. 3) on the connector nuts 24*a*, 24*b*. Then, the fuel line connectors 26*a*, 26*b* are threaded into the connector nuts 24*a*, 24*b*, respectively. As described above, the thread pattern 25 on the connector nuts 24*a*, 24*b*, must match the thread pattern 27 on the fuel line connectors 26*a*, 26*b*, respectively.

While the first housing 20 is shown as connecting to the connector nuts 24*a*, 24*b* by a threaded engagement, as is the engagement between connector nuts 24*a*, 24*b* and fuel line connectors 26*a*, 26*b*, other means of engagement may be employed for connecting these components including, but not limited to, adhesives, welds, and press fits.

Alternatively, the fuel line connectors 26*a*, 26*b* and connector nuts 24*a*, 24*b* may be removed from the design of the in-line fuel conditioner 10. In such an embodiment, the first housing 20 would connect to the entrance fuel line 12 and the exit fuel line 16.

Often fuel delivery systems may be near electromagnetic fields emitted from alternators or wires connected to batteries in vehicles or machines in which the fuel delivery system is used. Because the in-line fuel conditioner 10 creates its own magnetic fields to condition the fuel, as will be described in detail below, exposure to external magnetic or electromagnetic fields from the surrounding environment may compromise the magnetic fields produced by the in-line fuel conditioner 10, and thus, its effectiveness. If the in-line fuel conditioner 10 is being used in such an environment where external magnetic or electromagnetic fields are present, then the first housing 20 is preferably composed of steel to protect against the magnetic or electromagnetic fields from reaching the fuel in the in-line fuel conditioner 10. If steel is used to form the first housing 20, the first housing 20 may be treated, such as by applying a powder coat to its exterior, to protect against corrosion. However, if no magnetic or electromagnetic fields are detected near where the in-line fuel conditioner 10 will be placed, then the first housing 20 may be composed of stainless steel, which is beneficial due to its resistance against corrosion, or any other suitable material.

Figures 3, 4, 5:
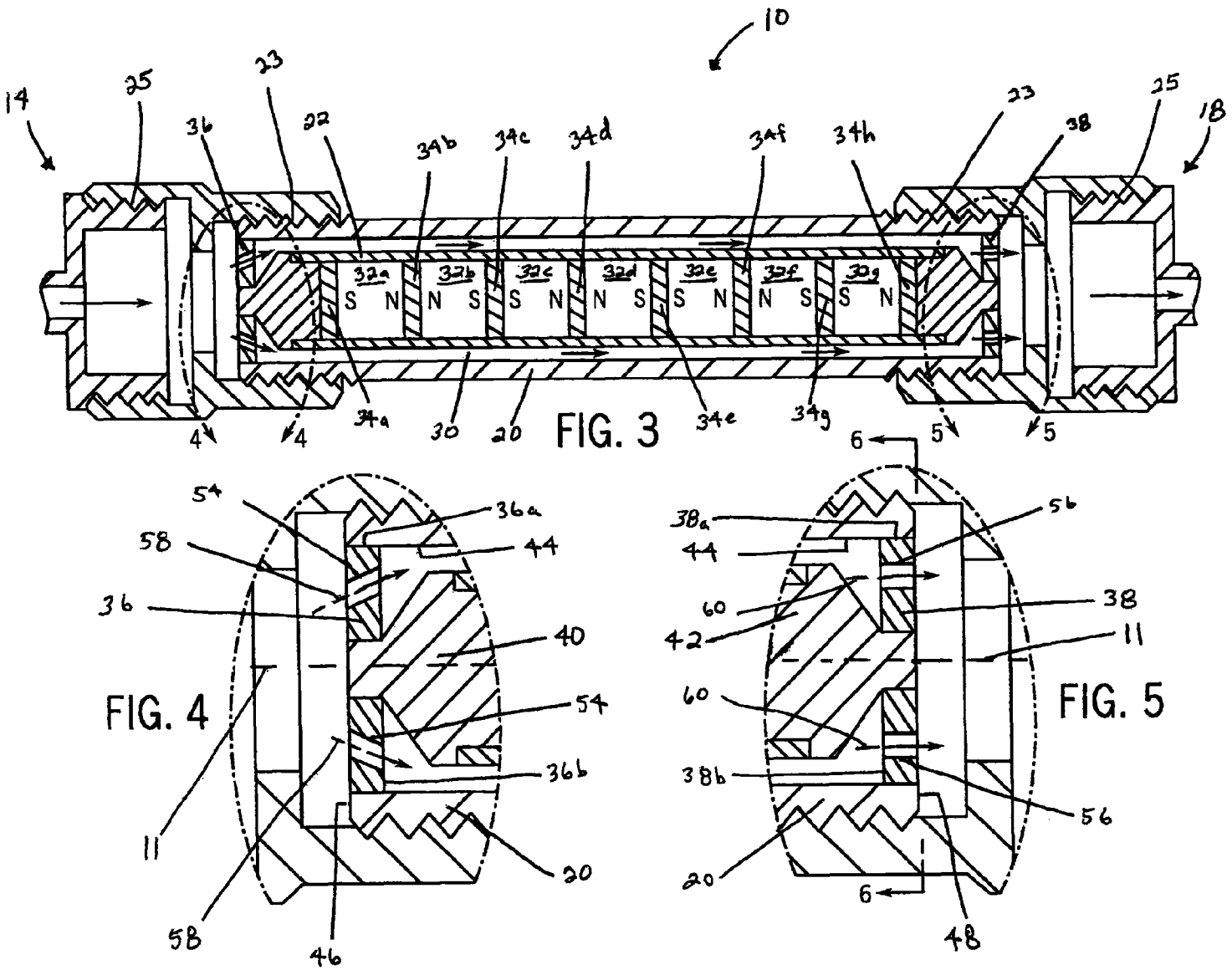
FIG. 3 is a cross-section view of the in-line fuel conditioner displayed in FIG. 1.
FIG. 4 is a detailed view showing the upstream plate of the in-line fuel conditioner displayed in FIG. 3.
FIG. 5 is a detailed view showing the downstream plate of the in-line fuel conditioner displayed in FIG. 3.

Turning now to FIG. 3, the in-line fuel conditioner 10 has a sealed chamber 30 that is defined by the first housing 20. The sealed chamber 30 is in fluid communication with the fuel inlet 14 and fuel outlet 18. The second housing 22 is placed within the chamber 30.

The second housing 22 includes seven magnets 32*a*, 32*b*, 32*c*, 32*d*, 32*e*, 32*f*, and 32*g*, and as shown in FIGS. 2 and 3, the second housing 22 may be constructed as a solid housing to form a seal around the magnets 32*a*-32*g* and protect them from corrosion. This may be especially important in applications where the engine, and thus the in-line fuel conditioner 10, is not used for substantial periods of time. Infrequent use may lead to fuel draining away from the in-line fuel conditioner 10 and possible corrosion of the magnets 32*a*-32*g*. Alternatively, the second housing 22 may be constructed as a mesh-type structure or other similar structure, wherein the fuel may contact the magnets 32*a*-32*g* directly. The second housing 22 may be composed of stainless steel, aluminum, or any other suitable metallic or non-metallic material for holding the magnets in their proper alignment, which is addressed in further detail below.

The seven magnets 32*a*-32*g* may be formed from a rare earth metal. Preferably, the magnets 32*a*-32*g* are formed from Neodymium, with Iron and Boron also forming part of the composition of the magnets 32*a*-32*g*. As seen in FIG. 3, the magnets 32*a*-32*g* may be cylindrical, or disc-shaped, to best fit in the cylindrical shaped second housing 22. To also help protect against corrosion, the magnets 32*a*-32*g* may be triple coated in a Nickel-Copper-Nickel layering scheme. The magnets 32*a*-32*g* may have a magnetic strength of 5597 Gauss at their surface.

The magnets 32*a*-32*g* in the second housing 22 are aligned in a distinct pattern. The magnet 32*a* placed nearest the fuel inlet 14 has its magnetic south pole facing the fuel inlet 14 and its magnetic north pole facing the fuel outlet 18. The magnet 32*g* placed nearest the fuel outlet 18 is arranged such that its magnetic north pole faces the fuel outlet 18 and its magnetic south pole faces the fuel inlet 14. The magnets 32*b*-32*f* placed in between magnet 32*a* and magnet 32*g* are arranged such that their magnetic poles oppose, or repel, the nearest pole of the magnet placed immediately upstream and the nearest pole of the magnet placed immediately downstream. For example, magnet 32*b* has its north pole facing upstream, or towards the fuel inlet 14, such that its north pole will oppose the north pole of magnet 32*a*. Magnet 32*b* has its south pole facing downstream, or towards the fuel outlet 18, such that its south pole will oppose the south pole of magnet 32*c*. As a result of this pattern of the magnets 32*a*-32*g* in the second housing 22, an odd number of magnets (1, 3, 5, 7, 9, etc. . . . ) will be placed in the second housing 22. While seven magnets are shown in the embodiment in FIGS. 1-9, other odd total amounts of magnets are still within the scope and spirit of the invention.

Importantly, the magnetic poles shown on magnets 32*a*-32*g* in FIG. 3 are labeled according to the convention adopted by the National Institute of Standards and Technology (NIST), formerly the National Bureau of Standards (NBS). In that standard, the pole of the magnet that is attracted to earth's magnetic north pole is labeled as the north pole of the magnet. Because the end of the needle of a compass that points to earth's magnetic north pole is also referred to as the "north" end of the needle, if one were to use a compass to determine the polarity of the magnets 32*a*-32*g*, the "north" end of the compass needle would oppose the north pole of magnets 32*a*-32*g* as labeled in FIG. 3.

While seven magnets 32*a*-32*g* with a specific orientation are shown and described in this embodiment, an in-line fuel conditioner 10 having magnets in a different orientation and with a different number of total magnets, including an even number of total magnets, will still be within the spirit and scope of the invention.

Spacers 34*a*, 34*b*, 34*c*, 34*d*, 34*e*, 34*f*, 34*g*, 34*h* may be placed in-between and on the ends of magnets 32*a*-32*g* within the second housing 22. The spacers 34*a*-34*h* may be cylindrical in shape and be composed of a magnetic metal oriented such that the spacers 34*a*-34*h* are attracted to the nearest pole of the magnet immediately upstream and the nearest pole of the magnet immediately downstream of each spacer. Alternatively, the spacers 34*a*-34*h* may be made of a non-magnetic material, such as aluminum, stainless steel, plastic, or the like. The spacers 34*a*-34*h* may be used to ensure adequate spacing of the magnets 32*a*-32*g* in the second housing 22. However, spacers 34*a*-34*h* may be removed from the in-line fuel conditioner 10 and the opposing poles of magnets may be used to ensure adequate spacing of the magnets 32*a*-32*g* in the second housing 22.

The in-line fuel conditioner 10 may also include an upstream plate 36 and downstream plate 38, as seen in FIG. 3 and further in detail in FIGS. 4 and 5. A portion of outer surfaces 36*a*, 38*b* of the plates 36, 38 contact the inner surface 44 of the first housing 20. Alternatively, outer surfaces 36*b*, 38*b* of plates 36, 38, respectively, may contact the outer surfaces 46, 48 of the first housing 20. In either case, the engagement of the plates 36, 38 with the first housing 20 may be completed by a press fit, weld, adhesive, or the like. This provides the benefit of structuring the second housing 22 within the first housing 20 such that fuel may flow around all sides of the second housing.

Referring back to FIG. 2, the plates 36, 38 may be structured so the longitudinal axis 52 of the second housing 22 is co-axial with the longitudinal axis 50 of the first housing 20 and the longitudinal axis 11 of the in-line fuel conditioner 10. Because of this arrangement, a greater majority of fuel particles are kept within closer proximity to the magnets 32*a*-32*g*. This allows the fuel to flow through the strongest magnetic fields along its flow path from the fuel inlet 14 to the fuel outlet 18 through the chamber 30. Allowing the flow path of the fuel to flow through the strongest magnetic fields of the magnets 32*a*-32*g* imparts beneficial conditioning on the fuel and aids in improved combustion and reduced emissions.

The plates 36, 38 are connected indirectly to the second housing 22 through the connection of the plates 36,38 to plugs 40, 42, respectively, and the connection of the plugs 40, 42 to the second housing 22. Following the convention established in referring to prior components of the in-line fuel conditioner 10, plug 40 is an upstream plug and plug 42 is a downstream plug. The connection of the plugs 40, 42 to the second housing 22 and to the plates 36, 38 may be completed by a press fit, adhesive, welds, or the like. The plugs 40, 42 may be in sealing engagement with the second housing 22. The combination of the upstream and downstream plugs 40, 42, the second housing 22, and the spacers 34*a*-34*h* help ensure that the magnets 32*a*-32*g* retain their order and alignment within the chamber 30 to provide beneficial conditioning to the fuel as it flows along its flow path from the fuel inlet 12 to the fuel outlet 18 of the in-line fuel conditioner 10.

As shown in FIGS. 3-6, the plates 36, 38 may sealingly engage the first housing 20. Looking more closely at the seal in the plates 36, 38 in FIGS. 5 and 6, the entire outer surfaces 36*a*, 38*a* contact the first housing 20 such that a seal is formed between the plate 38 and the first housing 20. As noted above, the seal between the plates 36, 38 and the first housing 20 may also be formed by contact between the outer surfaces 36*b*, 38*b* of plates 36, 38 with the outer surfaces 46, 48 of the first housing 20, respectively.

As a result of this seal, fuel is not allowed to flow through the chamber 30 of the in-line fuel conditioner 10 without the aid of at least one fuel entrance hole 54 and at least one fuel exit hole 56. In the embodiment shown in FIGS. 1-7, four fuel entrance holes 54 and four fuel exit holes 56 are in the upstream plate 36. The fuel entrance holes 54 and fuel exit holes 56 may be spaced evenly around plates 36, 38 as displayed for the downstream plate 38 in FIG. 6. The fuel holes 54, 56 create the benefit of splitting the fuel particles and causing turbulence in the fuel flow path as the fuel enters and exits the chamber 30 of the in-line fuel conditioner 10. The turbulence in the fuel flow path improves combustion of the fuel and reduces emissions.

As shown in FIG. 4, the fuel entrance holes 54 may be constructed such that an axis 58 of the fuel entrance holes is at an angle with respect to the longitudinal axis 11 of the in-line fuel conditioner 10. The angled construction of the fuel entrance holes 54 creates a helical flow of liquid fuel around the second housing 22, or a rifling effect, as the fuel passes through the chamber 30 in the in-line fuel conditioner 10 along the flow path from the fuel inlet 14 to the fuel outlet 18. Such a helical flow path of fuel increases the time that the fuel particles are exposed to the magnetic fields provided by the magnets 32*a*-32*g* disposed in the second housing 22. However, the fuel entrance holes 56 need not be constructed in this angled configuration.

Looking at the downstream plate 38 in further detail in FIG. 5, the fuel exit holes 56 may be constructed such that an axis 60 of the fuel exit holes 56 is parallel to the longitudinal axis 11 of the in-line fuel conditioner 10. Alternatively, the fuel exit holes 56 may be set up such that an axis 60 of the exit hole 56 is at an angle with respect to the longitudinal axis 11 of the in-line fuel conditioner 10, similar to the description above regarding the angled set-up of the fuel entrance holes 54.

Figures 6, 7, 8:
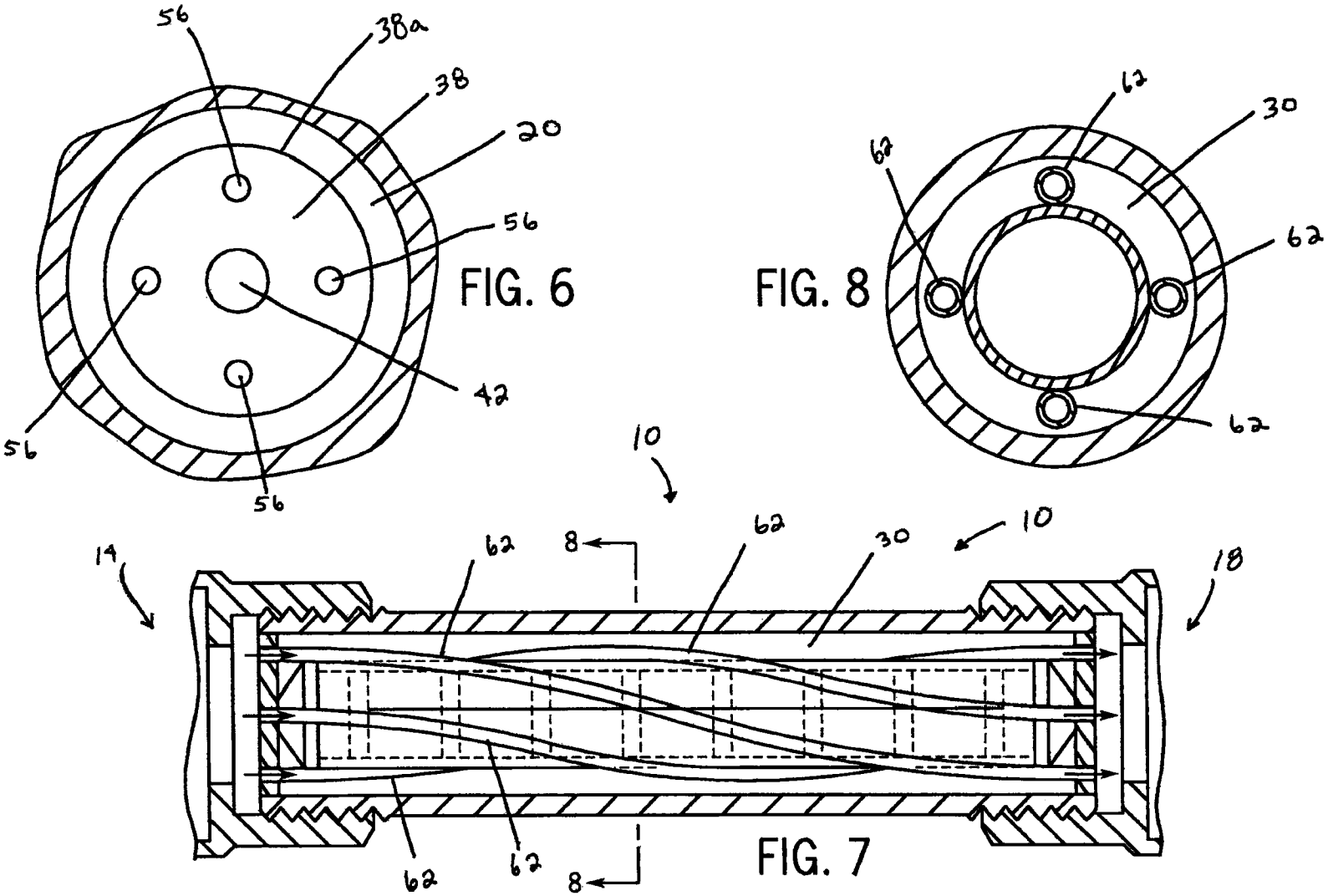
FIG. 6 is a cross-section view of the in-line fuel conditioner as shown in FIG. 5.
FIG. 7 is a partial cross-section view of an in-line fuel conditioner embodying the invention, including an alternative flow path for fuel, wherein the first housing and the fuel inlet and outlet are displayed in a cross-section view and the components disposed within the first housing are displayed in a side elevation view such that the helical path of the flow tubes may be depicted.
FIG. 8 is a cross-section view of the in-line fuel conditioner as shown in FIG. 7.

Turning now to FIG. 7, an alternative embodiment for the fuel flow path through the chamber 30 of the in-line fuel conditioner 10 is portrayed. In this embodiment, the in-line fuel conditioner 10 includes flow tubes 62 that are arranged in the chamber 30 of the in-line fuel conditioner 10. As seen in FIG. 8, there are four flow tubes 62 placed in the chamber 30 of the in-line fuel conditioner 10. The flow tubes 62 are preferably constructed of plastic tubing, however, the flow tubes 62 may also be constructed of non-magnetic metals, including, but not limited to, aluminum or stainless steel. The flow tubes 62 fit within the fuel entrance holes 54 and the fuel exit holes 56. When assembling this arrangement, the flow tubes 62 may be press fit into the fuel entrance and exit holes 54, 56, or an adhesive may be used to ensure the fitting between the flow tubes 62 and the entrance and exit holes 54, 56.

In the embodiment for the fuel path shown in FIGS. 7 and 8, the amount of flow tubes 62 matches the amount of fuel entrance holes 54 and fuel exit holes 56. In other words, each flow tube 62 connects to a separate fuel entrance hole 54 and a separate fuel exit hole 56. With this configuration, the fuel is restricted to a flow path flowing from the fuel inlet 14 through the fuel entrance holes 54, the flow tubes 62, the fuel exit holes 56, and the fuel outlet 18.

As seen in FIG. 7, the flow tubes 62 are arranged in the chamber 30 to wrap around the second housing 22 in a helical pattern. In FIG. 7, each flow tube 62 revolves around one half of the second housing 22, or revolves 180° around the second housing 22 from the fuel entrance holes 54 to the fuel exit holes 56. This helical path of the flow tubes 62 may be varied to increase the amount of revolutions the flow tubes 62 make around the second housing 22 in the chamber 30. By increasing the amount of revolutions the flow tubes 62 make around the second housing 22, the fuel is forced to travel a farther distance between the upstream plate 36 and the downstream plate 38 of the in-line fuel conditioner 10. As such, the fuel will be exposed to the magnetic fields emitted from magnets 32*a*-32*g* for a longer period of time and may receive increased conditioning as a result.

The flow tubes 62 also provide the additional benefit of allowing the second housing 22 to avoid direct exposure to fuel to lessen the chance of corrosion of the second housing 22. Furthermore, if the second housing 22 is constructed in a mesh format, the flow tubes 62 may protect the magnets 32*a*-32*g* and spacers 34*a*-34*h* from the corrosive environment as well.

Of course, the amount of fuel entrance and exit holes 54, 56 and flow tubes 62, as well as the diameters of those components, may be increased or decreased from the amount shown in FIGS. 7 and 8 and still be within the scope of the invention.

Figure 9:
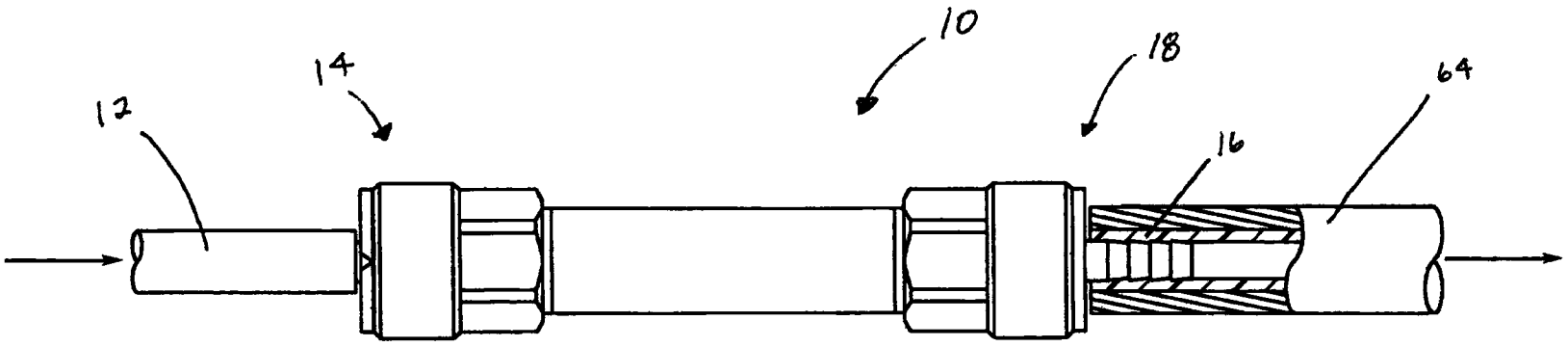
FIG. 9 is a cut out view of the in-line fuel conditioner of FIG. 1 further displaying an electromagnetic shield encasing the exit fuel line.

Moving now to FIG. 9, an electromagnetic shield 64 may be added to encase the exit fuel line 16. The electromagnetic shield 64 serves the purpose of protecting the fuel from other magnetic and electromagnetic fields caused by magnetic materials or electrical currents near the engine or fuel delivery system as the fuel leaves the in-line fuel conditioner 10 and is en route to the engine. The electromagnetic shield 64 is preferably composed of Co-Netic® Braided Sleeving, but may be composed of any material that provides magnetic or electromagnetic shielding properties.

The in-line fuel conditioner 10 may be installed during the construction of the fuel delivery system for the apparatus using an internal combustion engine, or, alternatively, the in-line fuel conditioner 10 may be retrofitted into a fuel delivery system. In either case, the fuel line in the fuel delivery system must be cut to allow for the length of the in-line fuel conditioner 10 to be placed in-line with the fuel delivery system as described above.

An additional benefit of the in-line fuel conditioner 10 may be to collect ferrous particles before such particles enter the engine, possible causing severe harm to the engine in the process. As the in-line fuel conditioner 10 may be placed downstream of a fuel filter, the in-line fuel conditioner 10 may act as a secondary trap for ferrous particles that passed through the fuel filter.

The foregoing description was primarily directed to a preferred embodiment of the invention. Although some attention was given to various alternatives within the scope of the invention, it is anticipated that one skilled in the art will likely realize additional alternatives within the spirit and scope of the invention that are now apparent from disclosure of embodiments of the invention. Accordingly, the scope of the invention should not be limited to the described embodiments. Rather, the following claims should be referenced to ascertain the full scope of the invention.

What is claimed is:

1. An in-line fuel conditioner for receiving a flow of liquid fuel, the fuel conditioner comprising:

a first housing defining a sealed chamber;

a fuel inlet in fluid communication with the sealed chamber;

a second housing disposed within the sealed chamber;

a number of magnets disposed in the second housing;

a fuel outlet in fluid communication with the sealed chamber; and a flow path in the sealed chamber for flow of the liquid fuel between the fuel inlet and the fuel outlet, and wherein the number of magnets disposed in the second housing is an odd number greater than one, a magnet is placed nearest the fuel inlet and is arranged such that its magnetic south pole faces the fuel inlet and its magnetic north pole faces the fuel outlet, another magnet is placed nearest the fuel outlet and is arranged such that its magnetic north pole faces the fuel outlet and its magnetic south pole faces the fuel inlet, and one or more remaining magnets are placed in between the magnet placed nearest the fuel inlet and the magnet placed nearest the fuel outlet and are arranged such that the magnetic poles of each of the one or more remaining magnets oppose the nearest pole of the magnet placed immediately upstream and the nearest pole of the magnet placed immediately downstream.

2. The in-line fuel conditioner of claim 1, wherein the second housing forms a seal around the magnets such that the liquid fuel does not contact the magnets.

3. The in-line fuel conditioner of claim 1, wherein the second housing is disposed in the sealed chamber such that the flow path allows the liquid fuel to flow around all sides of the magnets.

4. The in-line fuel conditioner of claim 1, further comprising:

an exit fuel line in fluid communication with the fuel outlet; and an electromagnetic shield encasing the fuel exit line.

5. An in-line fuel conditioner for receiving a flow of liquid fuel, the fuel conditioner comprising:

a first housing defining a sealed chamber;

a fuel inlet in fluid communication with the sealed chamber;

a magnet disposed in the sealed chamber;

an upstream plate with a hole;

a downstream plate with a hole;

a fuel outlet in fluid communication with the sealed chamber; and a flow path in the sealed chamber for flow of the liquid fuel moving between the fuel inlet and the fuel outlet;

wherein at least a portion of an outer surface of the upstream plate and at least a portion of an outer surface of the downstream plate engage the first housing, and the flow path allows fuel to flow from the fuel inlet through the hole in the upstream plate, the chamber, the hole in the downstream plate, and the fuel outlet, and wherein an axis of the hole in the upstream plate is at an angle with respect to a longitudinal axis of the in-line fuel conditioner.

6. The in-line fuel conditioner of claim 5, wherein the magnet is disposed in the second housing and the second housing is disposed in the sealed chamber such that the flow path allows the liquid fuel to flow around all sides of the magnet.

7. The in-line fuel conditioner of claim 5, wherein the magnet is disposed in the second housing and the second housing is disposed in the sealed chamber.

8. The in-line fuel conditioner system of claim 7, wherein the second housing forms a seal around the magnet such that the liquid fuel does not contact the magnet.

9. The in-line fuel conditioner of claim 5, wherein the magnet is arranged such that its magnetic south pole faces the fuel inlet and its magnetic north pole faces the fuel outlet.

10. The in-line fuel conditioner of claim 5, further comprising:

a flow tube disposed in the chamber that connects the hole in the upstream plate to the hole in the downstream plate, such that all the liquid fuel that passes through the sealed chamber is restricted to flowing through the flow tube.

11. The in-line fuel conditioner of claim 10, wherein the flow tube is arranged in a helical pattern in the sealed chamber.

12. The in-line fuel conditioner of claim 5, further comprising:

a plurality of holes in the upstream plate, a plurality of holes in the downstream plate, a plurality of flow tubes disposed in the sealed chamber, wherein each flow tube connects a hole in the upstream plate to a respective hole in the downstream plate, such that all the liquid fuel that passes through the sealed chamber is restricted to flowing through the plurality of flow tubes.

13. The in-line fuel conditioner of claim 12, wherein the plurality of flow tubes are arranged in a helical pattern in the sealed chamber.

14. The in-line fuel conditioner of claim 7, further comprising:

a number of magnets disposed in the second housing; wherein the number of magnets disposed in the second housing is an odd number greater than one, a magnet is placed nearest the fuel inlet and is arranged such that its magnetic south pole faces the fuel inlet and its magnetic north pole faces the fuel outlet, another magnet is placed nearest the fuel outlet and is arranged such that its magnetic north pole faces the fuel outlet and its magnetic south pole faces the fuel inlet, and one or more remaining magnets are placed in between the magnet placed nearest the fuel inlet and the magnet placed nearest the fuel outlet and are arranged such that the magnetic poles of each of the one or more remaining magnets oppose the nearest pole of the magnet placed immediately upstream and the nearest pole of the magnet placed immediately downstream.

15. The in-line fuel conditioner of claim 5, wherein an outer surface of the upstream plate and an outer surface of the downstream plate sealingly engage the first housing such that the flow path of the liquid fuel is constrained to flowing from the fuel inlet through the hole in the upstream plate, the chamber, the hole in the downstream plate, and the fuel outlet.

16. The in-line fuel conditioner of claim 5, further comprising:

an exit fuel line in fluid communication with the fuel outlet; and an electromagnetic shield encasing the fuel exit line.

17. An in-line fuel conditioner for receiving a flow of liquid fuel, the fuel conditioner comprising:

a first housing defining a sealed chamber;

a fuel inlet in fluid communication with the sealed chamber;

a second housing disposed within the sealed chamber;

a magnet disposed in the second housing;

an upstream plate with a hole;

a downstream plate with a hole;

an upstream plug;

a downstream plug;

a fuel outlet in fluid communication with the sealed chamber; and a flow path in the sealed chamber for flow of the liquid fuel between the fuel inlet and the fuel outlet;

wherein the upstream plate engages the upstream plug, the downstream plate engages the downstream plug, the upstream plug and the downstream plug sealingly engage the second housing, and an outer surface of the upstream plate and an outer surface of the downstream plate sealingly engage the first housing such that the flow path restricts the liquid fuel to flow from the fuel inlet through the hole in the upstream plate, the chamber, the hole in the downstream plate, and the fuel outlet, and wherein an axis of the hole in the upstream plate is at an angle with respect to a longitudinal axis of the in-line fuel conditioner.

* * * * *